US011160999B2

(12) United States Patent
Koiwa

(10) Patent No.: US 11,160,999 B2
(45) Date of Patent: Nov. 2, 2021

(54) PROTECTOR FOR HEAT-SENSITIVE ELEMENT OF SPRINKLER HEAD

(71) Applicant: SENJU SPRINKLER CO., LTD., Tokyo (JP)

(72) Inventor: Yasuaki Koiwa, Tokyo (JP)

(73) Assignee: SENJU SPRINKLER CO., LTD., Tokyo (JP)

( * ) Notice: Subject to any disclaimer, the term of this patent is extended or adjusted under 35 U.S.C. 154(b) by 119 days.

(21) Appl. No.: 16/616,120

(22) PCT Filed: Feb. 20, 2018

(86) PCT No.: PCT/JP2018/005847
§ 371 (c)(1),
(2) Date: Nov. 22, 2019

(87) PCT Pub. No.: WO2018/235334
PCT Pub. Date: Dec. 27, 2018

(65) Prior Publication Data

US 2020/0078626 A1 Mar. 12, 2020

(30) Foreign Application Priority Data

Jun. 23, 2017 (JP) ..... JP2017-122967

(51) Int. Cl.
*A62C 37/11* (2006.01)
*B05B 15/16* (2018.01)
(Continued)

(52) U.S. Cl.
CPC ..... *A62C 37/11* (2013.01); *A62C 37/12* (2013.01); *A62C 37/14* (2013.01); *B05B 15/16* (2018.02)

(58) Field of Classification Search
CPC ..... A62C 37/10; A62C 37/11; A62C 37/12; A62C 37/14; A62C 37/16; B05B 15/16
See application file for complete search history.

(56) References Cited

U.S. PATENT DOCUMENTS 3,454,097 A 7/1969 Groos
4,901,799 A 2/1990 Pepi et al.
(Continued)

FOREIGN PATENT DOCUMENTS

AU 2006232873 B2 10/2006
CN 101184554 A 5/2008
(Continued)

OTHER PUBLICATIONS

International Search Report and Written Opinion for PCT Patent App. No. PCT/JP2018/005847 (dated May 15, 2018) with English translation of the ISR.
(Continued)

*Primary Examiner* — Darren W Gorman
(74) *Attorney, Agent, or Firm* — Cermak Nakajima & McGowan LLP; Tomoko Nakajima

(57) ABSTRACT

To provide a protector for a heat-sensitive element of a sprinkler head, the protector being configured to be removably attached to a sprinkler head to protect a heat-sensitive element of the sprinkler head and being configured to be easily removed after completion of installation of the sprinkler head. A protector is to be attached to a sprinkler head including: a main body including a nozzle; frame arms extending from the main body in a water discharge direction of the nozzle; and a heat-sensitive element disposed between the frame arms. The protector includes: an opening through which the heat-sensitive element is insertable into the protector; a base opposite to the opening; lateral faces extending from the base toward the opening and lying adjacent to the frame arms; a flat face provided on an inner side of the base and of the lateral faces; and projections provided on the lateral faces.

10 Claims, 8 Drawing Sheets

(51) Int. Cl.
*A62C 37/12* (2006.01)
*A62C 37/14* (2006.01)

(56) References Cited

U.S. PATENT DOCUMENTS

| | | | | |
|---|---|---|---|---|
| 5,632,339 | A | 5/1997 | Fenske et al. | |
| 6,669,111 | B2 | 12/2003 | Vinson et al. | |
| 7,273,189 | B2 | 9/2007 | Ide et al. | |
| 7,757,967 | B1 | 7/2010 | Yang | |
| 7,900,852 | B2 | 3/2011 | Feenstra | |
| 9,027,660 | B2 * | 5/2015 | Oldham | B65D 25/005 169/37 |
| 2006/0219817 | A1 | 10/2006 | Franson et al. | |
| 2006/0219818 | A1 | 10/2006 | Franson et al. | |
| 2006/0219819 | A1 | 10/2006 | Franson et al. | |
| 2010/0059235 | A1 | 3/2010 | Feenstra | |
| 2010/0132962 | A1 * | 6/2010 | Silva, Jr. | A62C 37/12 169/37 |
| 2010/0170685 | A1 | 7/2010 | Franson et al. | |
| 2011/0121100 | A1 | 5/2011 | Feenstra | |
| 2012/0159786 | A1 | 6/2012 | Franson et al. | |
| 2012/0261498 | A1 | 10/2012 | Kameishi et al. | |
| 2013/0306334 | A1 | 11/2013 | Koiwa | |
| 2014/0290968 | A1 | 10/2014 | Franson et al. | |
| 2015/0083442 | A1 | 3/2015 | Koiwa | |
| 2017/0028236 | A1 * | 2/2017 | Macomber | A62C 37/12 |
| 2017/0326393 | A1 * | 11/2017 | Oldham | A62C 35/68 |
| 2019/0143163 | A1 * | 5/2019 | Schnell | A62C 35/68 169/37 |

FOREIGN PATENT DOCUMENTS

| | | | |
|---|---|---|---|
| CN | 102665825 | A | 9/2012 |
| CN | 103418104 | A | 12/2013 |
| DK | 169888 | B | 3/1995 |
| JP | 56-158271 | U | 11/1981 |
| JP | 2002-210034 | A | 7/2002 |
| JP | 2008-534143 | A | 8/2008 |
| TW | M303746 | U | 6/1995 |
| TW | 201532643 | A | 9/2015 |

OTHER PUBLICATIONS

Office Action from Chinese Patent App. No. 201880042084.1 (dated Oct. 9, 2020).
Office Action for Taiwan Patent App. No. 11020618950 (dated Jun. 30, 2021).

* cited by examiner

PROTECTOR FOR HEAT-SENSITIVE ELEMENT OF SPRINKLER HEAD

This application is a national phase entry under 35 U.S.C. § 371 of PCT Patent Application No. PCT/JP2018/005847, filed on Feb. 20, 2018, which claims priority under 35 U.S.C. § 119 to Japanese Patent Application No. 2017-122967, filed Jun. 23, 2017, both of which are incorporated by reference.

TECHNICAL FIELD

The present invention relates to a protector that protects a heat-sensitive element of a sprinkler head.

BACKGROUND ART

A sprinkler head automatically activates to spay water when a fire breaks out. Under normal conditions, a nozzle is closed with a heat-sensitive breakable portion. In the presence of heat of fire, a heat-sensitive element mounted inside the heat-sensitive breakable portion acts on the heat-sensitive breakable portion, which in turn breaks down to open the nozzle.

Such a sprinkler head is fitted with a protective cap (see, for example, PTL 1) or a protector (see, for example, PTL 2) that protects a heat-sensitive element and a heat-sensitive breakable portion from impact during transportation and installation.

Since heat-sensitive element and heat-sensitive breakable portions of frame-type sprinkler heads in particular are uncovered and subject to external force, some overseas standards require that such frame-type sprinkler heads be fitted with protective caps or protectors.

As heat-sensitive element, glass bulbs are commonly used overseas. A glass bulb is obtained by sealing, for example, alcohol in glass. When being subjected to heat of fire, alcohol vaporizes to cause the glass to break down, and the nozzle of the sprinkler head is opened accordingly. During transportation and installation, the glass bulb is surrounded by a protector, which protects the glass bulb from external force.

A protector 36 illustrated in FIG. 9 has two flat faces, namely, a flat face 38 and a flat face 40, which are provided to sandwich two frame arms, namely, a frame arm 70 and a frame arm 72 of a sprinkler head S and are connected to each other via a hinge surface 54. A fastener 60 is provided opposite the portion where the flat faces 38 and 40 are connected to each other via the hinge surface 54. With the frame arms 70 and 72 and a glass bulb 30 being sandwiched between the flat faces 38 and 40, the fastener 60 is fitted in a hole 62, such that the glass bulb 30 is protected from external force. Once the sprinkler head S is installed, the fastener 60 may be disengaged to remove the protector 36.

CITATION LIST

Patent Literature

PTL 1: Japanese Unexamined Patent Application Publication No. 2002-210034

PTL 2: U.S. Pat. No. 6,669,111

PTL 3: U.S. Pat. No. 7,900,852

SUMMARY OF INVENTION

Technical Problem

To disengage the fastener 60 of the protector 36 mentioned above, the flat faces 38 and 40 need to be moved in a direction of separating away from each other. Additionally, this movement needs to be accomplished in such a way as not to give an impact to the glass bulb 30, and this necessitates disengaging the fastener 60 with both hands. For example, with the flat face 38 being held in a left hand, the flat face 40 is moved with a right hand in a direction of separating away from the flat face 38 to disengage the fastener 60, and thus, there has been demands for greater work efficiency.

In place of a glass bulb, a link including two metal plates bonded to each other via a low-melting alloy may be provided as a heat-sensitive element. Since the link protrudes outward from between the frame arms, a protector having a more complex structure is necessary and the protector needs to be attached or removed with caution in such a manner that no interference occurs between the link and the protector.

The present invention has therefore been made in view of the aforementioned problem, and it is an object of the present invention to provide a protector for a heat-sensitive element of a sprinkler head, the protector being configured to be removably attached to a sprinkler head to protect a heat-sensitive element of the sprinkler head and being configured to be easily removed after completion of installation of the sprinkler head.

Solution to Problem

To attain the aforementioned objective, the present invention provides a protector for a heat-sensitive element of a sprinkler head as in the following.

Specifically, the protector is to be attached to a sprinkler head that includes: a main body including a nozzle; frame arms extending from the main body in a water discharge direction of the nozzle; and a heat-sensitive element disposed between the frame arms. The protector includes: an opening through which the heat-sensitive element is insertable into the protector; a base opposite to the opening; lateral faces extending from the base toward the opening and lying adjacent to the frame arms; and projections provided on the lateral faces to catch the frame arms.

The nozzle is included in the main body of the sprinkler head, the frame arms extend from the main body in the water discharge direction of the nozzle, and a heat-sensitive breakable portion is disposed between the frame arms. A closing member is disposed between the nozzle and the heat-sensitive breakable portion to close the nozzle, and the heat-sensitive breakable portion includes the heat-sensitive element, which functions in the presence of heat. The protector is structured in such a way as to fit to the frame arms and can be therefore attached or removed with one hand. The heat-sensitive element is enclosed with the base, the lateral faces, and the flat face provided on the inner side of the base and of the lateral faces and is protected from external force accordingly. With the frame arms being located adjacent to the corresponding lateral faces of the protector, the projections provided on the lateral faces keep the protector in engagement with the frame arms.

Tips of the lateral faces of the protector extend beyond the frame arms to the opening. The projections on the lateral faces are provided adjacent to the opening to catch the frame arms. The lateral faces of the protector extending beyond the frame arms thus cover the entirety of the heat-sensitive element, and the heat-sensitive element is in turn protected from external force.

Advantageous Effects of Invention

The present invention therefore provides a protector for a heat-sensitive element of a sprinkler head, the protector being configured to be removably attached to a sprinkler head to protect a heat-sensitive element of the sprinkler head and being configured to be easily removed after completion of installation of the sprinkler head.

DESCRIPTION OF EMBODIMENTS

First Embodiment (FIGS. 1 to 4

Figure 1:
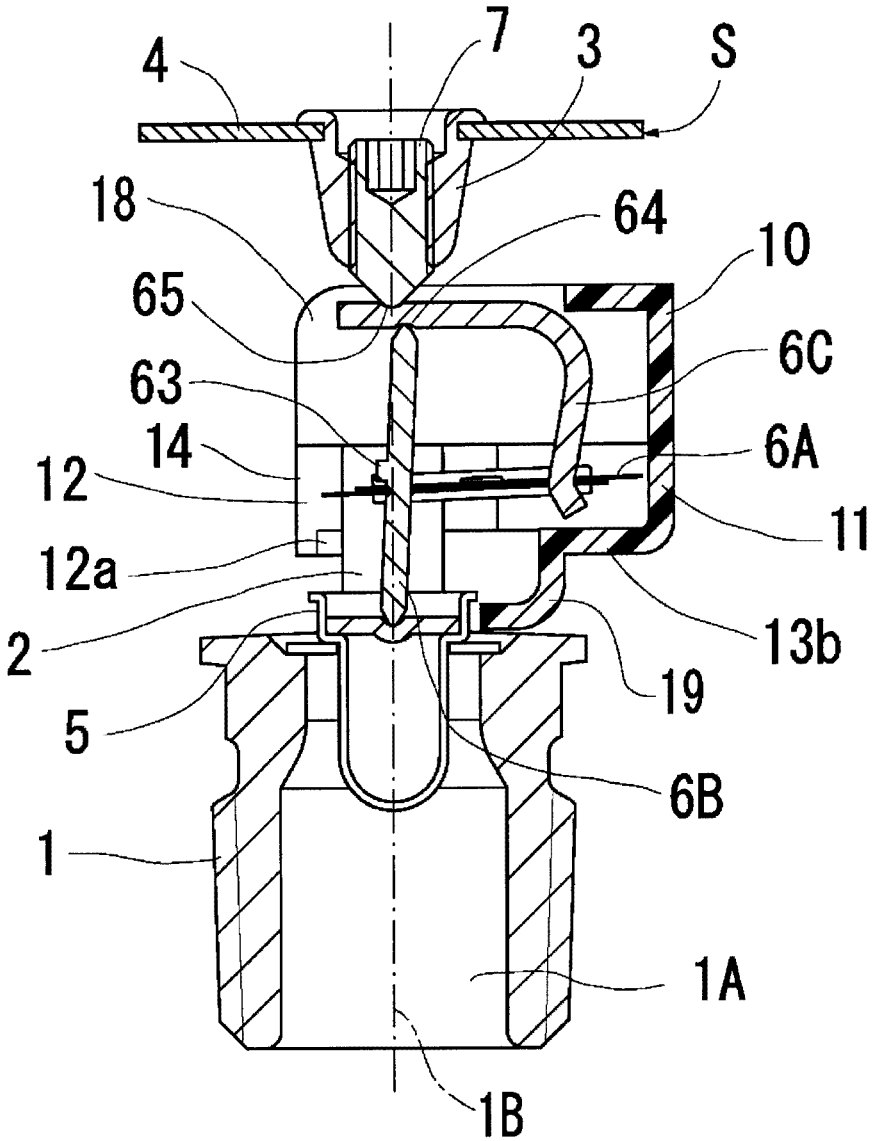
FIG. 1 is a sectional view of a sprinkler head fitted with a protector according to a first embodiment.
Figure 2:
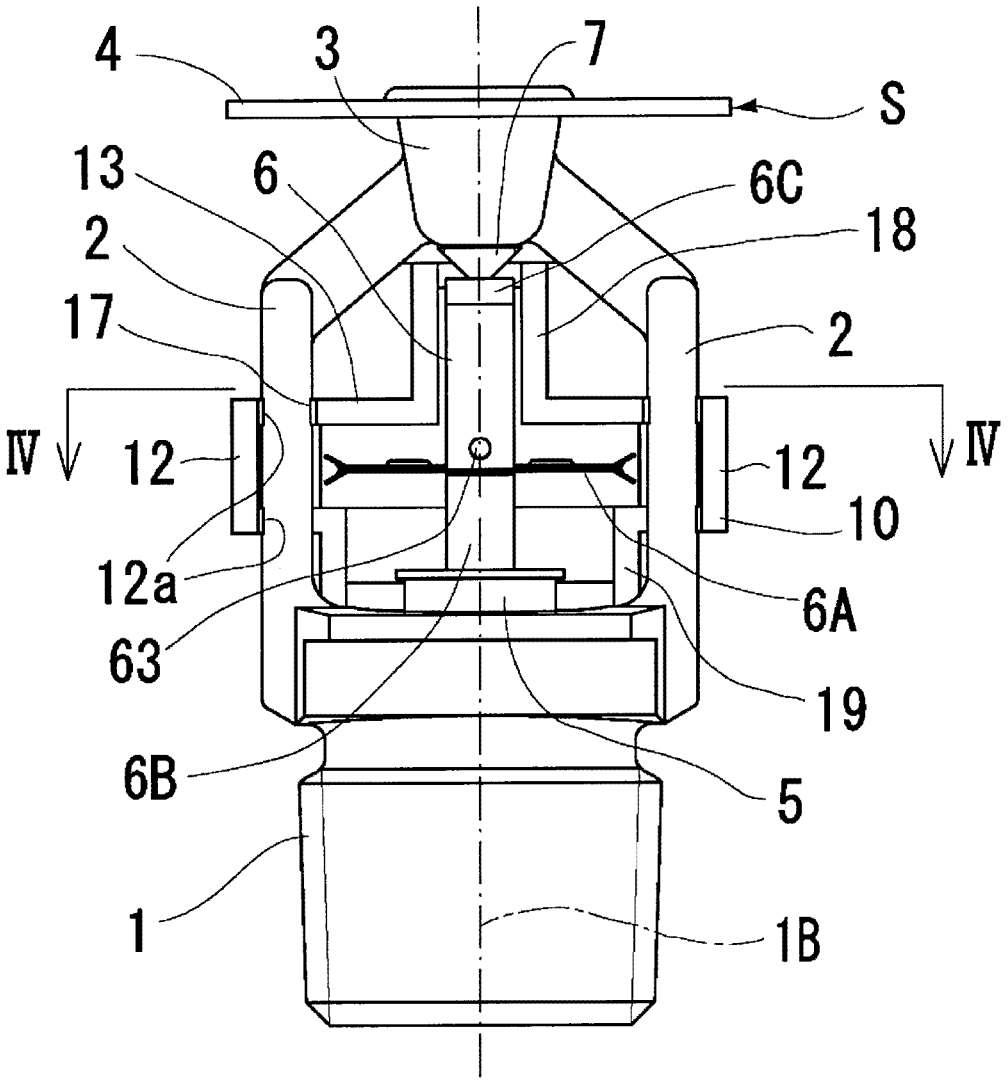
FIG. 2 is a front view of the sprinkler head illustrated in FIG. 1.
Figure 3:
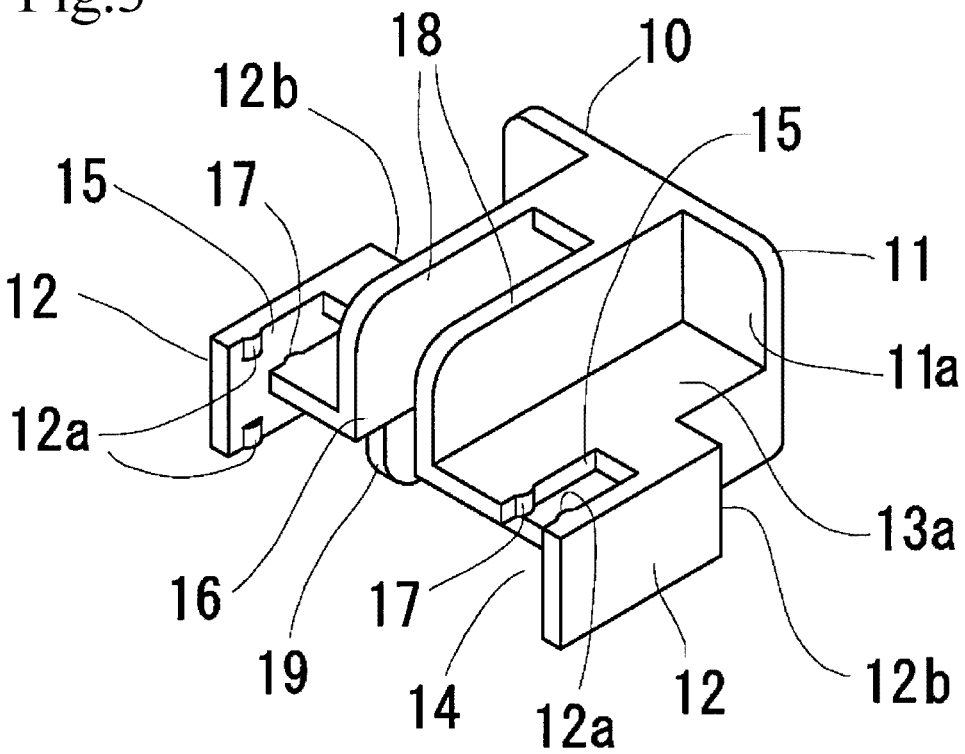
FIG. 3 is a perspective view of the protector according to the first embodiment.
Figure 4:
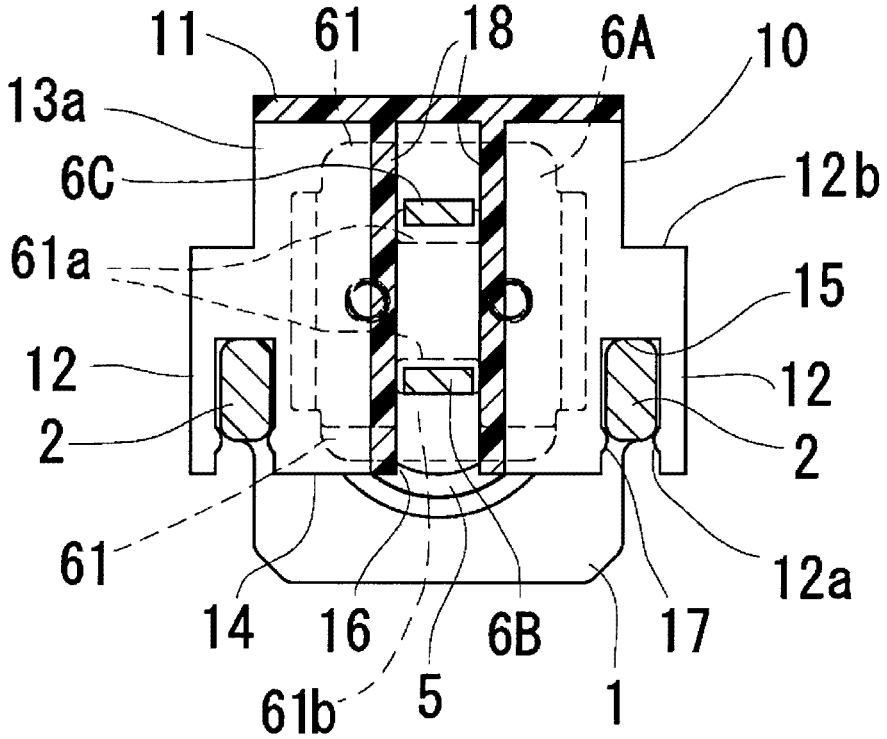
FIG. 4 is a sectional view of the sprinkler head illustrated in FIG. 2 and taken along line IV-IV.
Figure 5:
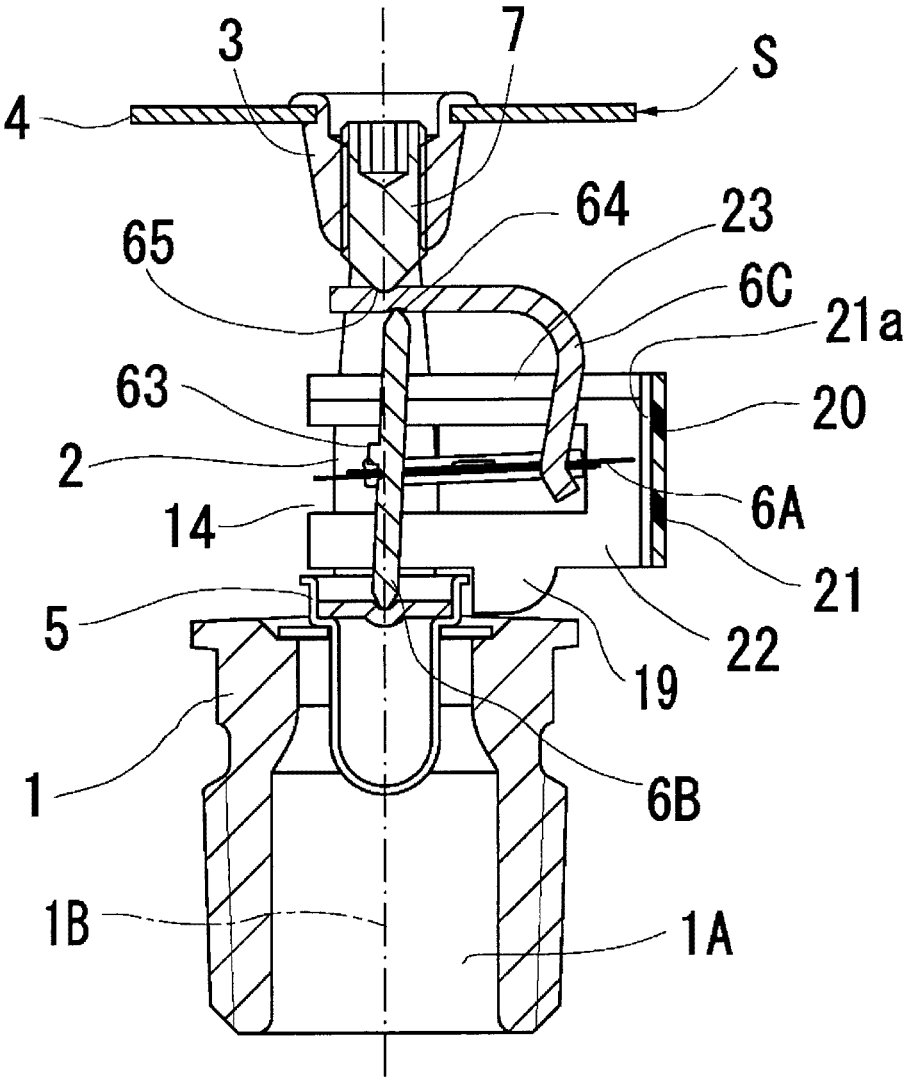
FIG. 5 is a sectional view of a sprinkler head fitted with a protector according to a second embodiment.
Figure 6:
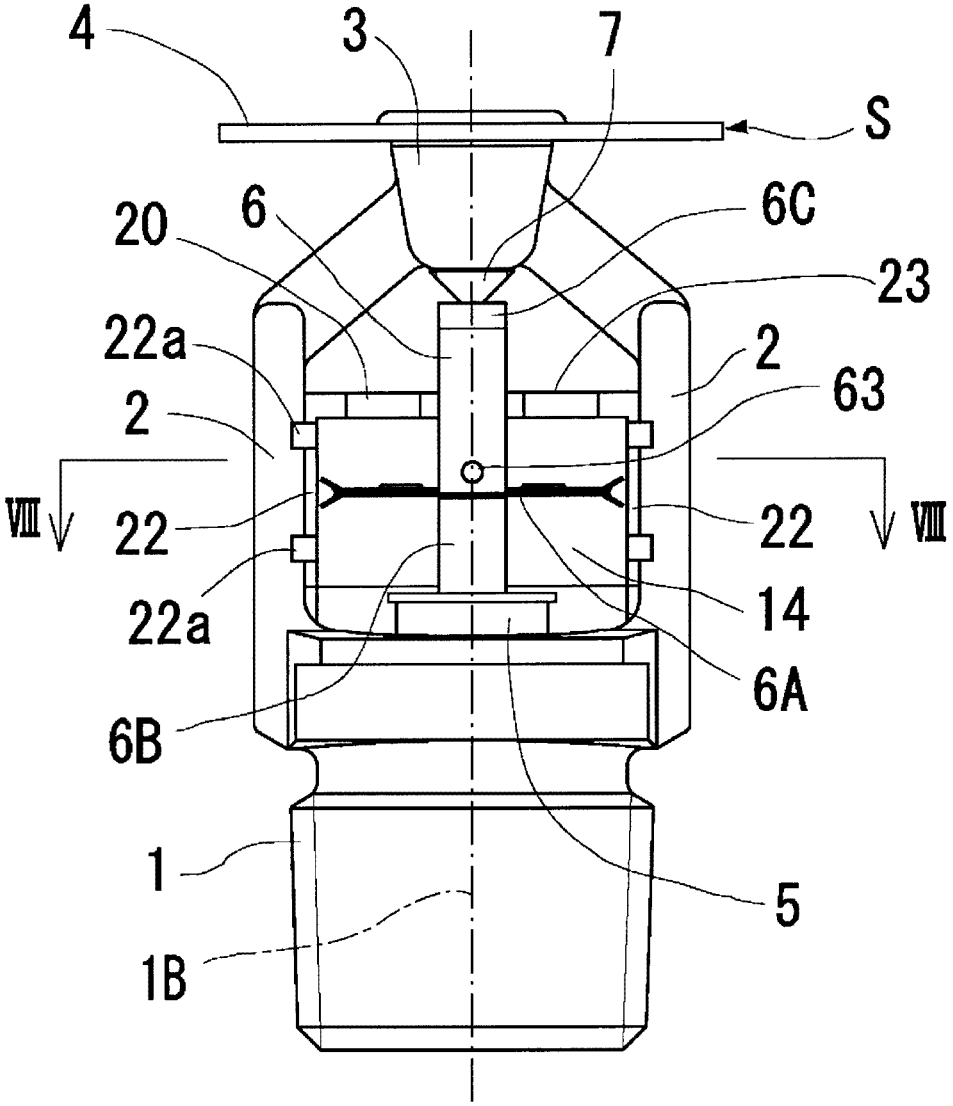
FIG. 6 is a front view of the sprinkler head illustrated in FIG. 5.

A protector 10 according to a first embodiment illustrated in FIG. 1 is disposed in a manner so as to cover a heat-sensitive element of a sprinkler head S. The sprinkler head S is connected to a water-supply pipe (not illustrated) and includes: a main body 1 including a nozzle 1A; and two frame arms 2 extending from the main body 1 in a water discharge direction. Tips of the frame arms 2 are connected to a boss 3 disposed on a central axis 1B of the nozzle and having a hollow shape. A deflector 4 is disposed on a tip of the boss 3.

The deflector 4 sprinkles water in all directions by causing collision of water discharged from the nozzle and has a substantially discoid shape. The deflector 4 has slits (not illustrated) formed in a peripheral edge thereof, and the sprinkling pattern is controlled in accordance with the shape of the slits.

In ordinary times, the outlet of the nozzle 1A is closed with a closing member 5. A heat-sensitive breakable portion 6 is disposed between the closing member 5 and the boss 3. The heat-sensitive breakable portion 6 is constructed of a link 6A, a strut 6B, and a lever 6C. The link 6A is a heat-sensitive element that functions in the presence of heat of fire and is constructed of two thin metal plates 61 bonded to each other via a low-melting alloy. The low-melting alloy to be used has a melting point of 60 to 200° C., and a low-melting alloy having a melting point of 72° C. or a low-melting alloy having a melting point of 96° C. is commonly used.

Each of the metal plates 61 having a substantially rectangular shape has a hole 61*a* at one end portion and a slit 61*b* at another end portion. The two metal plates 61 are bonded to each other via a low-melting alloy in such a manner that one end portion provided with the hole 61*a* overlaps an end portion opposite to the one end portion. With the metal plates 61 being bonded to each other, the hole 61*a* of one metal plate 61 is positioned on the slit 61*b* of the other metal plate 61. The strut 6B and the lever 6C extend through the corresponding holes 61*a*.

The strut 6B is strip-shaped, with one end being fitted to the closing member 5 disposed at the outlet of the nozzle 1A and the other end being fitted to a tip of the lever 6C. As mentioned above, the strut 6B extends through the hole 61*a* of the link 6A. A projection 63 is provided at the midpoint of the strut 6B, and the link 6A is held at a position close to the projection 63.

The lever 6C is a long, narrow plate bent into a substantially L-shape. As mentioned above, one end portion of the lever 6C extends through the hole 61*a* of the link 6A. The other end portion of the lever 6C is fitted to the strut 6B, and the lever 6C has a groove 64, to which the tip of the strut 6B is fitted.

The surface opposite to the surface provided with the groove 64 has a recessed portion 65. The recessed portion 65 is located closer to the other end of the lever 6C than the groove 64 is. An impress screw 7 screwed in the boss 3 is in contact with the recessed portion 65. When the tip of the impress screw 7 presses the recessed portion 65 of the lever 6C, force is exerted on the lever 6C in manner so as to cause the lever 6C to rotate about the groove 64, in which the strut 6B is fitted. With one end portion of the lever 6C extending through hole 61*a* of the link 6A, the lever 6C is prevented from rotating. The link 6A, the strut 6B, and the lever 6C constituting the heat-sensitive breakable portion 6 are thus kept in engagement with each other. The impress screw 7 holds and presses the closing member 5 against the nozzle 1A via the heat-sensitive breakable portion 6.

When the low-melting alloy in the link 6A melts at the time of occurrence of fire, one metal plate 61 slips away from the other metal plate 61 due to the aforementioned rotation of the lever 6C. Consequently, the engagement state of the heat-sensitive breakable portion 6 is cleared, such that the link 6A, the strut 6B, and the lever 6C are disengaged and the closing member 5 supported by the strut 6B then falls away from the nozzle 1A to open the nozzle 1A.

The protector 10 according to the first embodiment protects the link 6A mentioned above and is removably engaged with the two frame arms 2. The protector 10 includes a base 11 and lateral faces 12 extending along the frame arms 2 from the respective ends of the base 11 disposed adjacent to the link 6A on the lever 6C side. With steps 12*b* being formed in the middle, the lateral faces 12 protrude outward. Tip portions of the lateral faces 12 are disposed on the outer sides of the frame arms 2 in a manner so as to be located beyond the frame arms 2.

A portion of the base 11 higher than the lateral faces 12 (closer to the boss 3) is a holding portion 11*a*. The holding portion 11*a* is provided in such a way as to be easily pinched with fingers at the time of attachment or removal of the protector 10.

An opening 14, through which the link 6A may be put in and out, is provided opposite the base 11. Flat faces 13*a* and 13*b* are provided on the inner side of the base 11 and of the lateral faces 12. The link 6A may be fitted between the flat faces 13*a* and 13*b*. A tip of the flat face 13*a* facing the boss 3 and tips of the lateral face 12 extend beyond the frame arms 2 to the opening 14. The flat face 13*a* has gap for accommodations 15, to which the frame arms 2 is fitted. The gap for accommodations 15 eliminate or reduce the possibility of interference between the flat face 13*a* and the frame arms 2.

Projections 12*a* are provided on the tip portions of the lateral faces 12. Similar projections, namely, projections 17 are located in the gap for accommodations 15 close to the opening 14. The projections 12*a* and 17 catch the frame arms 2 fitted in the gap for accommodations 15, such that the protector 10 is retained on the sprinkler head S in a stable manner. Thus, the protector 10 does not easily come off when the protector 10 is subjected to vibrations during transportation or comes into contact with a hand or an object during installation. The projections 12*a* and 17 also eliminate or reduce the possibility that the protector 10 will fall off from, for example, a side-wall type sprinkler head installed in such a manner that the frame arms 2 are parallel to the floor.

The flat face 13*a* has a gap for accommodation 16. The strut 6B and the lever 6C, which are components of the heat-sensitive breakable portion 6, and the impress screw 7 are fitted in the gap for accommodation 16. This eliminates or reduces the possibility of interference between the heat-sensitive breakable portion 6 and the flat face 13*a*. Extension portions 18 extend from edges of the gap for accommodation 16 along the central axis 1B of the nozzle to the vicinity of the boss 3. The strut 6B and the lever 6C are covered with the extension portion 18 and are thus protected from external force and dust.

The flat face 13*b* on the nozzle 1A side is smaller than the flat face 13*a*. The length of the flat face 13*b* extending from the base 11 toward the opening 14 is shorter than the length of the flat face 13*a* extending from the base 11 toward the opening 14. The flat face 13*b* is bent toward the nozzle 1A and along an edge of a leg 19, which will be described later. This eliminates or reduces the possibility of interference between the link 6A and the flat face 13*b* at the time of removal of the protector 10.

The flat face 13*b* is provided with the leg 19, which extends toward the nozzle 1A. The leg 19 is disposed on the outer side of the closing member 5. Once the protector 10 is attached, the extension portions 18 and the leg 19 mentioned above block the protector 10 from moving along the central axis 1B of the nozzle. The edge of the leg 19 is rounded so that the leg 19 does not get caught in the main body 1 at the time of removal of the protector 10.

The protector 10 having the aforementioned structure is attached prior to the shipment of the sprinkler head S to protect the link 6A from external impact during transportation and installation of the sprinkler head S. When the sprinkler head S is thus delivered to the installation site, the protector 10 is attached to the sprinkler head S. The heat-sensitive breakable portion 6 is accommodated in the protector 10 in such a manner that the base 11 is on the lever 6C side and the opening 14 is on the strut 6B side opposite to the base 11. The frame arms 2 are fitted in the corresponding gap for accommodations 15, and the heat-sensitive breakable portion 6 is fitted in the gap for accommodation 16.

The sprinkler head S with the protector 10 attached thereto is mounted onto a water-supply pipe. Once a ceiling is boarded, the protector 10 is removed. The protector 10 according to the first embodiment may be removed in such a manner that an edge of the holding portion 11*a* pinched between a thumb and a forefinger is pulled out. As illustrated in FIG. 1, the base 11 including the holding portion 11*a* is separated from the frame arms 2 so that the thumb and the forefinger do not interfere with the frame arms 2. Hooking a finger on an edge of the holding portion 11*a* will facilitate pulling out the protector 10. Owing to the extension portion 18 and the leg 19 on the protector 10, the flat faces 13*a* and 13*b* may be pulled out without interfering with the heat-sensitive breakable portion 6.

The sprinkler head S is connected to a pipe disposed in a ceiling cavity. The deflector 4, the closing member 5, and the components disposed therebetween are exposed on the interior of a room. The tip of the leg 19, which may be close to the ceiling surface at the time of removal of the protector 10, is rounded so as not to scratch the ceiling surface when the protector 10 is pulled out away from the frame arms 2.

Second Embodiment (FIGS. 5 to 8

A protector 20 according to a second embodiment includes a base 21, lateral faces 22, and a flat face 23. Note that the same reference signs refer to the parts structured as in the first embodiment, and a description thereof will be omitted. The protector 20 according to the second embodiment may be applicable to the sprinkler head S described above. When the protector 20 accommodates the heat-sensitive breakable portion 6, the base 21 is disposed on the lever 6C side. The protector 20 has the opening 14 on the strut 6B side opposite to the base 21. Further, the protector 20 has the lateral faces 22 extending from the base 21 toward the opening 14 and lying adjacent to corresponding frame arms 2, and projections 22*a* provided on the lateral faces 22 to catch the frame arms 2.

The base 21 is disposed adjacent to the link 6A on the lever 6C side, and the lateral faces 22 are disposed on the respective ends of the base 21. The base 21 has a groove 21*a* extending along the central axis 1B of the nozzle, and the lateral faces 22 may be pivotally moved about the groove 21*a*. Specifically, when the two lateral faces 22 are pinched between fingers from outer surfaces thereof, tips of the lateral faces 22 are moved toward each other, with the groove 21*a* as a pivot point. In this state, the lateral faces 22 may be inserted between the frame arms 2 (see FIG. 8(*a*)).

The lateral faces 22 extend from the base 21 toward the frame arms 2 and lie between the two frame arms 2. Each lateral face 22 has, on the outer surface thereof, the projections 22*a* and a projection 22*b* to catch the frame arm 2. The projections 22*a* are located on the tip portion of the lateral face 22, and the projection 22*b* is located closer to the base 21 than the projections 22*a* are. The frame arm 2 is caught between each of the projections 22*a* and the projection 22*b*.

The extension amount (length) of the projection 22*b* extending outward from the lateral face 22 is greater than the extension amount (length) of each projection 22*a* extending outward from the lateral face 22. Once the projections 22*b* come into contact with the corresponding frame arms 2 at the time of insertion of the lateral faces 22 between the frame arms 2, the base 21 is controlled not to get close to the link 6A any further. Subsequently, the groove 21*a* or the vicinity thereof may be pressed from the outer surface of the base 21 toward the link 6A, such that the tips of the lateral faces 22 pivotally move in an outward direction and the projections 22*a* and 22*b* are then fitted to the frame arms 2 (see FIG. 8).

The height of each projection 22*a* tapers from the point of catching the frame arm 2 toward the tip portion of the lateral face 22. This enables the projections 22*a* to smoothly slide between the frame arms 2 when the protector 20 is attached to the frame arms 2.

Figure 7:
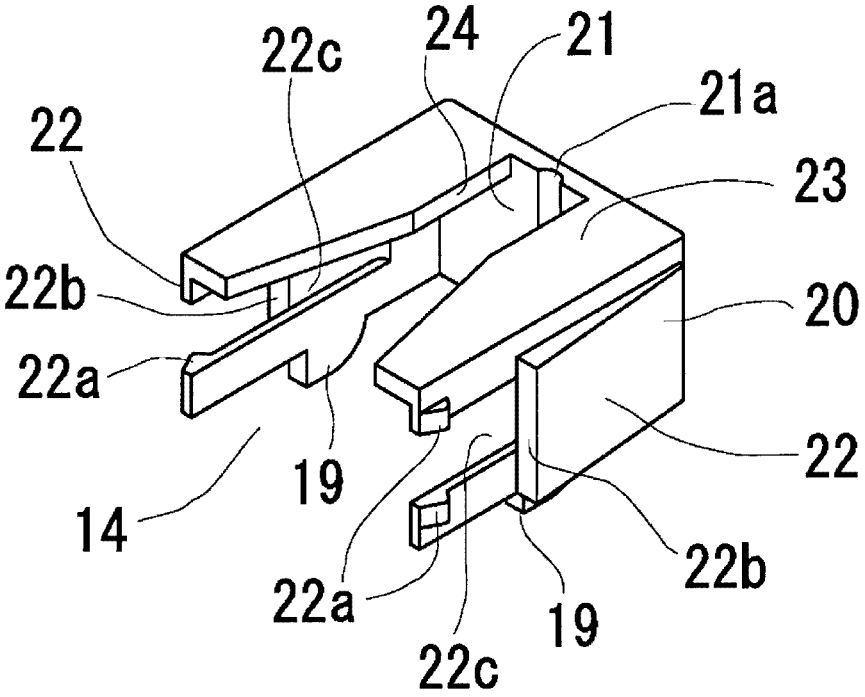
FIG. 7 is a perspective view of the protector according to the second embodiment.
Figure 8A:
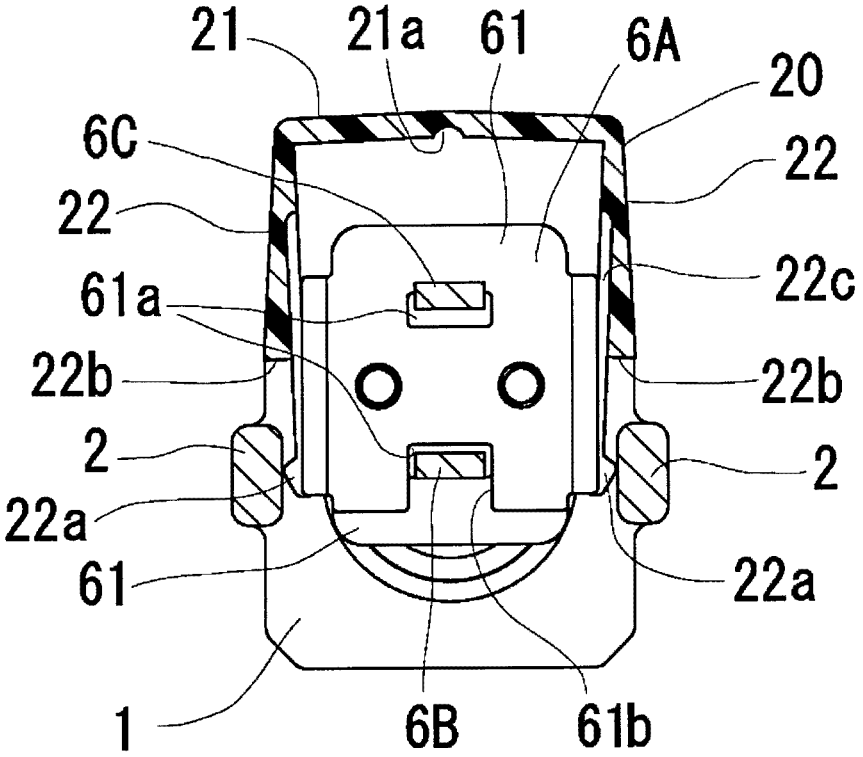
FIG. 8 is a sectional view of the sprinkler head illustrated in FIG. 6 and taken along line VIII-VIII.
Figure 8B:
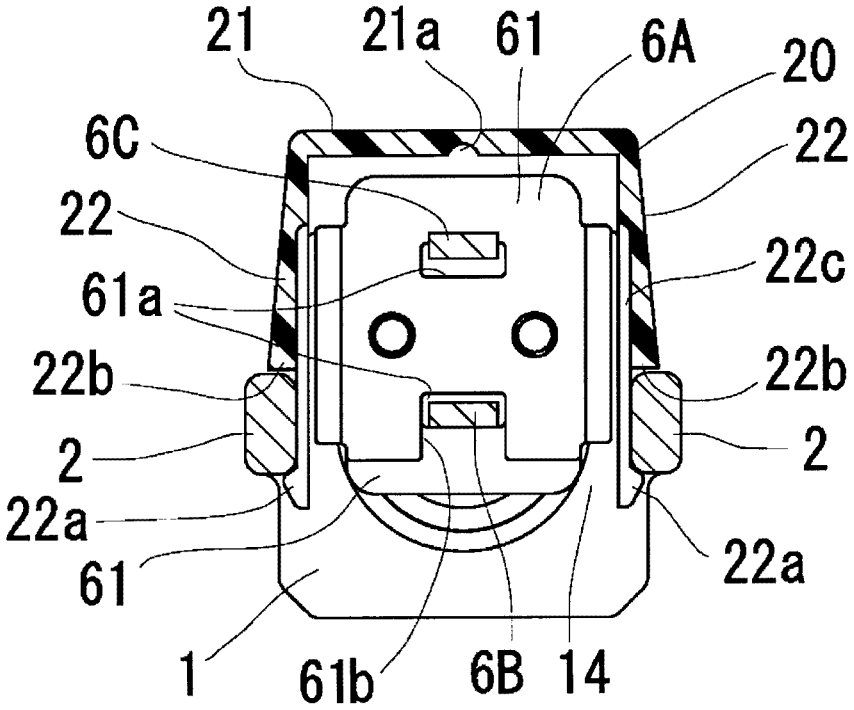
Figure 9:
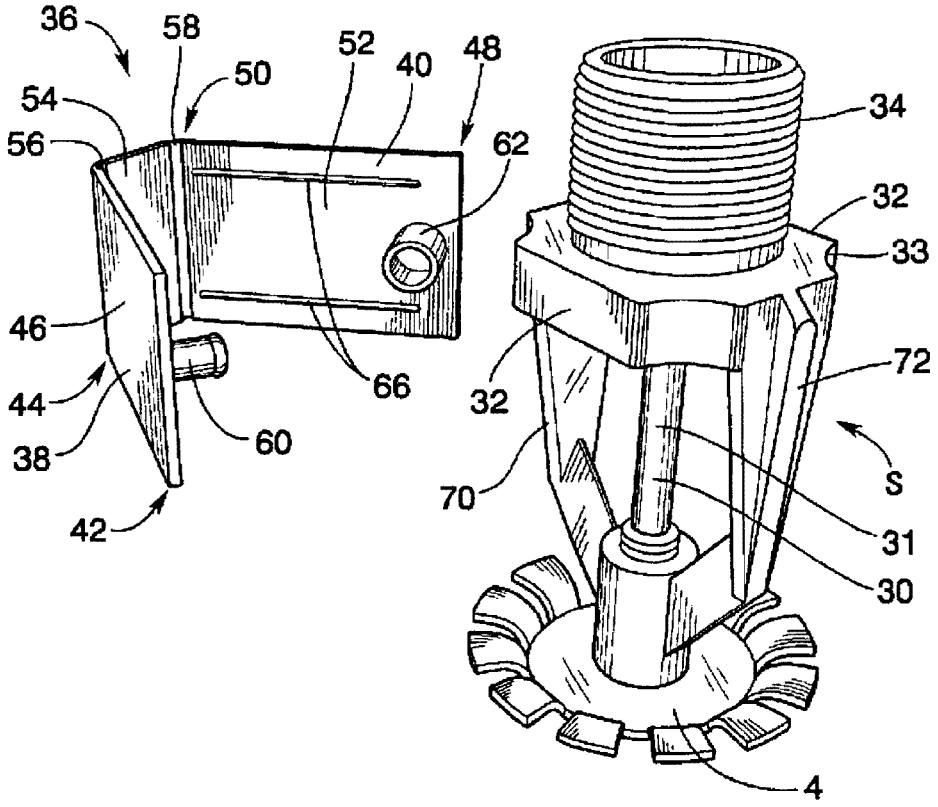
Fig.9 PRIOR ART
FIG. 9 is a perspective view of a conventional protector and a conventional sprinkler head.

Each lateral face 22 has a slit 22*c* extending from the tip of the lateral face 22 toward the base 21. The slit 22*c* is provided adjacent to the link 6A to eliminate or reduce the possibility of interference between the lateral face 22 and the link 6A at the time of attachment or removal of the protector 20. Referring to FIG. 7, the projections 22*a* are provided respectively on the top and the bottom of the slit 22*c*.

The flat face 23 is provided in a manner so as to be surrounded with the base 21 and the lateral faces 22. The flat face 23 is provided on the inner side of the base 21 and of the lateral faces 22 in a manner so as to face the boss 3. The opening 14, through which the link 6A may be put in and out, is opposite to the base 21. The link 6A is enclosed with the base 21, the lateral faces 22, and the flat face 23 so that the link 6A is protected from external force.

A tip of the flat face 23 and tips of the lateral faces 22 are located beyond the frame arms 2 to the opening 14. The flat face 23 has a gap for accommodation 24 to make a room for the strut 6B and the impress screw 7. The gap for accommodation 24 of the flat face 23 extends to the groove 21*a* and is wider on the opening 14 side than on the groove 21*a* side. This eliminates or reduces the possibility that interference will occur between the flat face 23 and the strut 6B (or the impress screw 7) when the lateral faces 22 are pivotally moved about the groove 21*a* to bring the tips of the lateral faces close to each other.

The protector 10 described above is applicable to a heat-sensitive element that is a glass bulb. In this case, the gap for accommodation 16 is to be made wide enough for a glass bulb to pass therethrough. The extension portion 18 may be additionally provided close to the gap for accommodation 16 in a manner so as to extend along the glass bulb. Alternatively, a plurality of flat faces 13 may be stacked in layers. These configurations are also applicable to the protector 20.

REFERENCE SIGNS LIST

S sprinkler head
1 main body
2 frame arm
3 boss
4 deflector
5 closing member
6 heat-sensitive breakable portion
10, 20 protector
11, 21 base
12, 22 lateral face
13 (13*a*, 13*b*), 23 flat face
14 opening
15 gap for accommodation (second gap for accommodation)
16, 24 gap for accommodation (first gap for accommodation)
12*a*, 17, 22*a*, 22*b* projection
22*c* slit

The invention claimed is:

1. A protector for a heat-sensitive element of a sprinkler head that includes: a main body including a nozzle; frame arms extending from the main body in a water discharge direction of the nozzle; and the heat-sensitive element that is a link including two metal plates bonded to each other via a low-melting alloy; a strut catching the heat-sensitive element; and a lever catching the heat-sensitive element disposed between the frame arms, the protector comprising:
- an opening through which the heat-sensitive element, the strut and the lever are insertable into the protector;
- a base opposite to the opening;
- a pair of lateral faces extending from the base beyond the frame arms toward the opening when installed to the sprinkler head so that the protector is detachably engaged with the frame arms; and
- first projections provided on a tip of each of the pair of the lateral faces to catch the frame arms, the first projections protruding perpendicularly to an extension direction of the pair of lateral faces so as to catch the frame arms in a stable manner.

2. The protector for a heat-sensitive element of a sprinkler head according to claim 1, wherein
- the tip of each of the pair of the lateral faces extend beyond the frame arms toward the opening, and
- the first projections on the tip of each of the pair of the lateral faces are provided adjacent to the opening to catch the frame arms.

3. The protector for a heat-sensitive element of a sprinkler head according to claim 1, further comprising a flat face that is provided on an inner side of the base and each of the pair of the lateral faces and has a first gap for accommodation in which the strut and the lever are to be fitted.

4. The protector for a heat-sensitive element of a sprinkler head according to claim 3, further comprising an extension portion extending from the first gap for accommodation along a central axis of the nozzle.

5. The protector for a heat-sensitive element of a sprinkler head according to claim 3, wherein the flat face has second gaps for accommodations in which the frame arms are to be fitted, tips of the second gaps for accommodations being provided with second projections that catch the frame arms.

6. A protector for a heat-sensitive element of a sprinkler head that includes: a main body including a nozzle; frame arms extending from the main body in a water discharge direction of the nozzle; and the heat-sensitive element that is a link including two metal plates bonded to each other via a low-melting alloy; a strut catching the heat-sensitive element; and a lever catching the heat-sensitive element disposed between the frame arms, the protector comprising:
- an opening through which the heat-sensitive element, the strut and the lever are insertable into the protector;
- a base opposite to the opening;
- a pair of lateral faces extending from the base beyond the frame arms toward the opening when installed to the sprinkler head so that the protector is detachably engaged with the frame arms; and
- first projections provided on a tip of each of the pair of the lateral faces to catch the frame arms,
- wherein the base has a groove extending along a central axis of the nozzle, and
- the tip of each of the pair of the lateral faces is movable, with the groove as a pivot point.

7. The protector for a heat-sensitive element of a sprinkler head according to claim 6, wherein a flat face is provided on an inner side of the base and each of the pair of the lateral faces, a first gap for accommodation is provided on the flat face, the first gap for accommodation accommodating the strut and the lever, and the first gap for accommodation of the flat face extends to the groove.

8. The protector for a heat-sensitive element of a sprinkler head according to claim 6, wherein the pair of the lateral faces is to be inserted between the frame arms.

9. The protector for a heat-sensitive element of a sprinkler head according to claim 1, further comprising a holding portion provided on the base or closer to the base than to the first projections that catch the frame arms.

10. The protector for a heat-sensitive element of a sprinkler head according to claim 1, wherein the first projections protrude in a direction in which the frame arms are arranged.

* * * * *